US006588031B2

(12) United States Patent
Hecker

(10) Patent No.: US 6,588,031 B2
(45) Date of Patent: Jul. 8, 2003

(54) BATH TAP FITTING

(75) Inventor: Hans-Hermann Hecker, Oberboihingen (DE)

(73) Assignee: Hansa Metallwerke AG (DE)

( * ) Notice: Subject to any disclaimer, the term of this patent is extended or adjusted under 35 U.S.C. 154(b) by 0 days.

(21) Appl. No.: 10/100,775

(22) Filed: Mar. 19, 2002

(65) Prior Publication Data

US 2002/0133874 A1 Sep. 26, 2002

(30) Foreign Application Priority Data

Mar. 26, 2001 (DE) ..... 101 14 854

(51) Int. Cl.[7] ..... E03C 1/04

(52) U.S. Cl. ..... 4/675; 4/496; 4/678; 137/801; 285/90; 285/330

(58) Field of Search ..... 4/675, 496, 678; 137/801, 359; 285/404, 90, 330, 331, 322, 323

(56) References Cited

U.S. PATENT DOCUMENTS 3,827,728 A * 8/1974 Hynes ..... 285/90
4,303,263 A * 12/1981 Legris ..... 285/249
4,798,404 A * 1/1989 Iyanicki ..... 285/12
6,301,727 B1 * 10/2001 Bertrand et al. ..... 4/678
6,378,912 B1 * 4/2002 Condon et al. ..... 285/220

FOREIGN PATENT DOCUMENTS

DE 41 08 458 9/2002

* cited by examiner

*Primary Examiner*—David J. Walczak
*Assistant Examiner*—Azy Kokabi
(74) *Attorney, Agent, or Firm*—Factor & Partners

(57) ABSTRACT

A bath tap fitting is composed in the known way of a securing device which can be attached to a mounting plate and a movable outlet spout fitted to this. The securing device comprises a securing body which is composed of a lower part and an upper part which can be pushed onto the lower part so that it cannot turn but can be adjusted for height. An adjusting bush is axially fitted in the upper part of the securing body, which however can be turned. It has in the lower area an outer thread, with which it is screwed into a threaded hole of the lower part of the securing body. By turning the adjusting bush therefore the height of the upper part can be changed in comparison to the lower part. The upper part grips over the lower part with a skirt which is divided into segments from below by axis-parallel slits and has an outer thread there. A nut is screwed onto this outer thread which via a cam effect in each case depending on the amount of turn presses the segments of the skirt of the upper part to a greater or lesser extent against the lower part of the securing body. As a result not only the height of the upper part is fixed in comparison to the lower part, but also any play between the upper part and the lower part, which could lead to movement of the outlet spout, is completely eliminated.

2 Claims, 3 Drawing Sheets

BATH TAP FITTING

The invention relates to a bath tap fitting with a) a securing device which can be fitted to a mounting plate and has:
   aa) a securing body which is composed of a lower part and an upper part which can be pushed onto the lower part so that it cannot turn but can be adjusted for height;
   ab) an adjusting bush which in the upper area is axially fitted on the upper part of the securing body, but in contrast to this can be turned and in the lower area is screwed into a threaded hole of the lower part of the securing body;
   ac) a securing device, which sets the height of the upper part of the securing body in relation to the lower part;

b) an outlet spout which can be fitted onto the upper part of the securing body.

Mounting plates, on which bath fittings, in particular bath taps, have to be secured, frequently have a decorative covering, for example tiling. Since this decorative covering in individual cases can have varying thickness, the securing device for the bath tap fitting must be designed so that the underside of the outlet spout can be set at varying heights. In order to achieve this, until now bath taps have been installed with the securing device described above which have a securing body composed of a lower part and an upper part. Since the upper part of the securing body must be moved in contrast to the lower part, a certain, although minor play is essential for the non-turning connection of these two parts.

Bath tap fittings which satisfy higher demands for quality and comfort, have considerable dimensions. If a user holds onto these for support, very great forces can occur which act on the securing body. Any play between the upper part and the lower part of the securing body is unpleasantly perceived by the user as "looseness", even though this is in fact very minute and would be insignificant for any objective useful measurement.

With known outlet fittings of the type mentioned at the beginning a grub screw, which is screwed through a threaded hole of the upper part against a face of the lower part is generally used as a securing device, which sets the height of the upper part of the securing body in relation to the lower part. This however is linked with a dual disadvantage: on the one hand accessibility of the grub screw from the side in many instances is difficult for reasons of space; on the other hand it is not possible with the aid of the grub screw to completely compensate for any play between upper part and lower part of the securing body and thus to guarantee a completely firm connection of the outlet spout to the securing body.

The aim of the present invention is to design a bath tap fitting of the type mentioned at the beginning so that the securing device is easier to access, particularly from above, and any play between upper part and lower part of the securing body is completely eliminated in their locked position.

This aim according to the invention is achieved in that c) the upper part of the securing body grips over the lower part so that it cannot turn with a skirt which is divided into segments from underneath by slits and in which the area adjacent to the slits bears an outer thread;

d) a nut is screwed onto the outer thread of the skirt of the upper part which through cam effect in each case depending on the amount of turn presses the segments of the skirt of the upper part to a greater or lesser extent against the lower part of the securing body.

The securing device according to the invention is thus now no longer formed by a grub screw but by the segments having a certain flexibility in the radial direction in the lower skirt area of the upper part of the securing body which reacts cam-wise with the nut which can be screwed onto the outer thread of the skirt. This has the dual advantage that it can be used from above without difficulty since the nut can be easily reached with a corresponding tool. Furthermore the skirt of the upper part lies uniformly on all sides against the lower part so that in fact any play between upper part and lower part of the securing body is eliminated in all directions when the nut is tightened. This contrasts with the state of the art, where when the grub screw is tightened any play between these parts can only be eliminated in the direction of movement of the grub screw.

With an advantageous embodiment of the invention the cam effect is produced by the skirt of the upper part being expanded downward in the area of the slits over a cone face and the inner surface of the nut being expanded downward at its lower end over a complementary cone face.

BRIEF DESCRIPTION OF THE DRAWINGS

An embodiment of the invention is explained in more detail below by way of the drawings; these show FIG. 1 an axial sectional view through a bath tap fitted to a mounting plate.

DETAILED DESCRIPTION OF THE DRAWINGS

Figure 1:
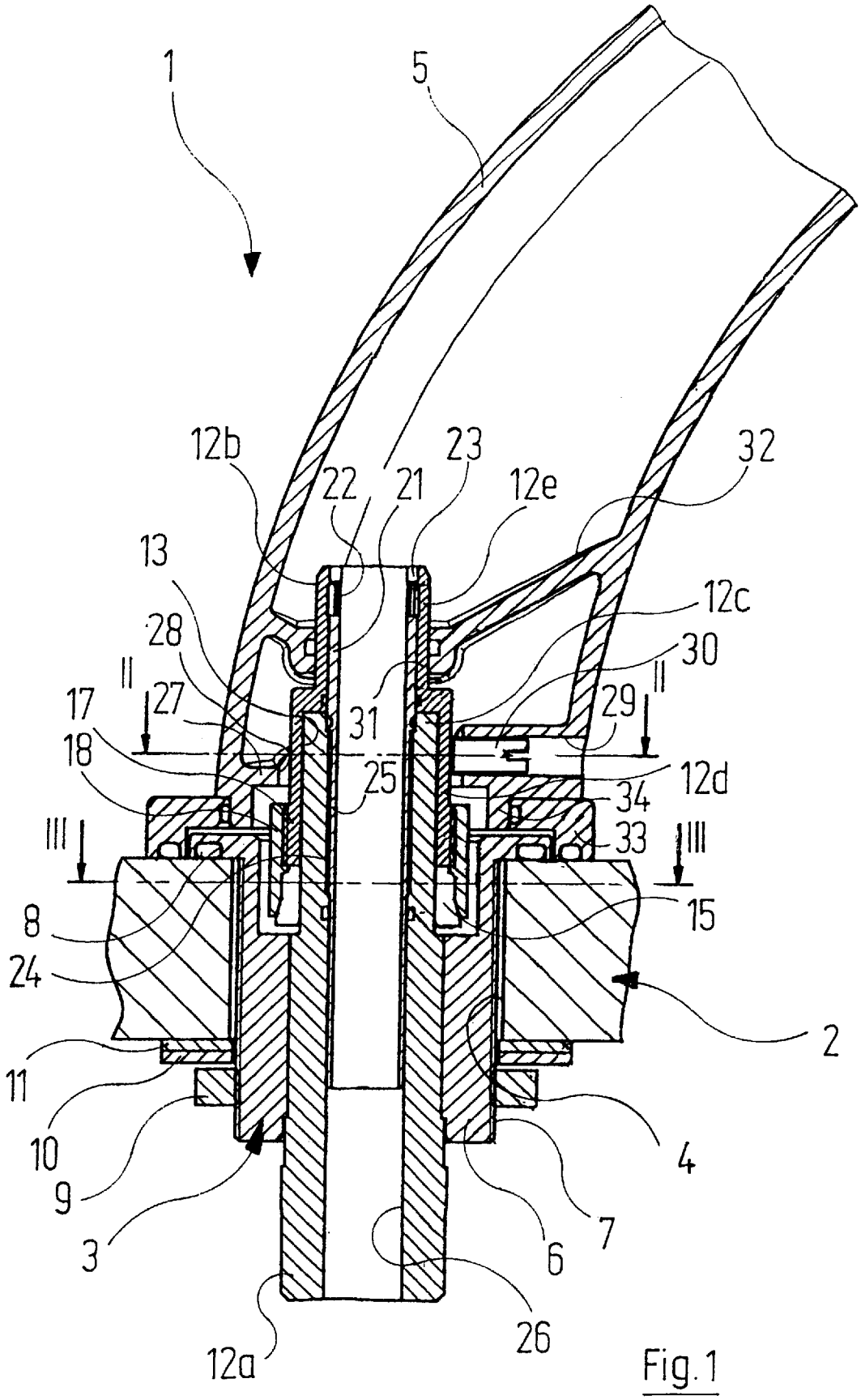

FIG. 1 shows a bath tap, the whole of which is identified with the reference number 1 and is fitted to a mounting plate 2, for example a carrier frame for bathtub edge mounting. The bath tap 1 includes a securing device 3, which is mounted in a drilled hole 4 of the mounting plate 2 in the way described below as well as an outlet spout 5 only partly shown, which is seated movably on the securing device 3 in a way also described further below.

The securing device 3 has a push-in nozzle 6 which is fed in through the drilled hole 4 of the mounting plate 2 from above and on its outer surface area supports an outer thread 7. A radially proud flange 7 which lies on the upper side of the mounting plate 2, with an O-ring—not shown—inserted in between, is molded onto the upper end of the push-in nozzle 6. A nut 9 screwed from below onto the outer thread 7 of the push-in nozzle 6 when tightened with shim disks 10, 11 inserted in between, lies against the underside of the mounting plate 2, as a result of which the push-in nozzle 6 is secured.

A securing body 12 made up of a lower part 12*a* and an upper part 12*b* seated on this extends through the push-in nozzle 6. The lower part 12*a* of the securing body 12 is joined to the push-in nozzle 6 by soldering. In that axial area, in which the lower part 12*a* of the push-in part 12 lies on the push-in nozzle 6, it has a circular cross-section. A neck 12*c* which has a hexagonal cross-section is molded over it on the lower part 12*a*, as can be seen in particular from FIGS. 2 and 3.

The upper part 12*b* of the securing body 12 has a skirt 12*d* extending downwards and a neck 12*e* running upwards. The skirt 12*d* has an inside recess 13, the cross-section shape of which corresponds to the cross-section shape of the neck 12*c* of the lower part 12*a*, so that the neck 12*c* of the lower part 12*a* is seated in the recess 13 so that it does not turn.

Figure 2:
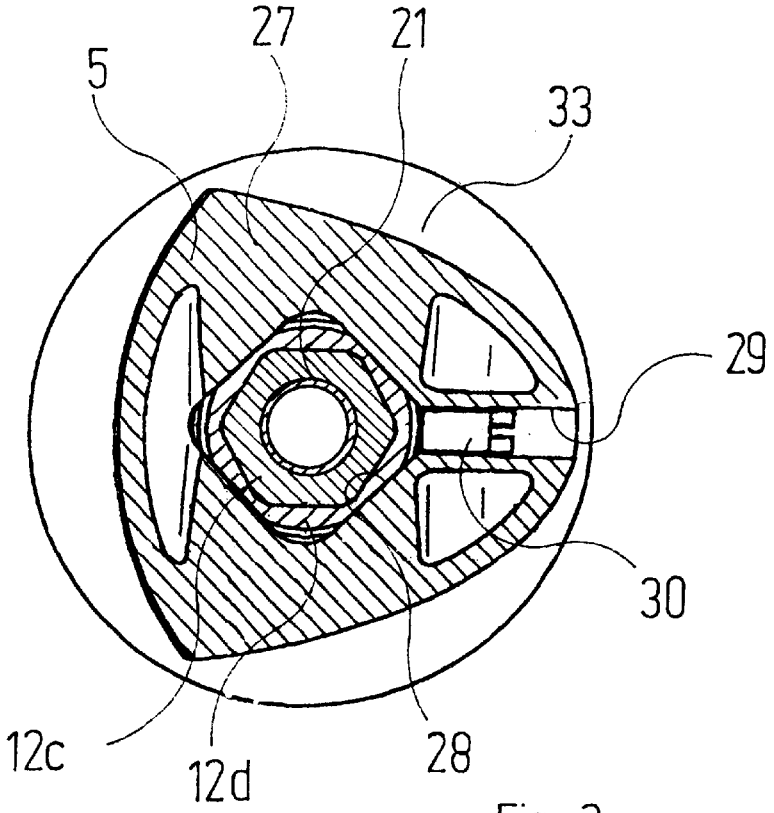
FIG. 2 a sectional view according to line II—II of FIG. 1.
Figure 3:
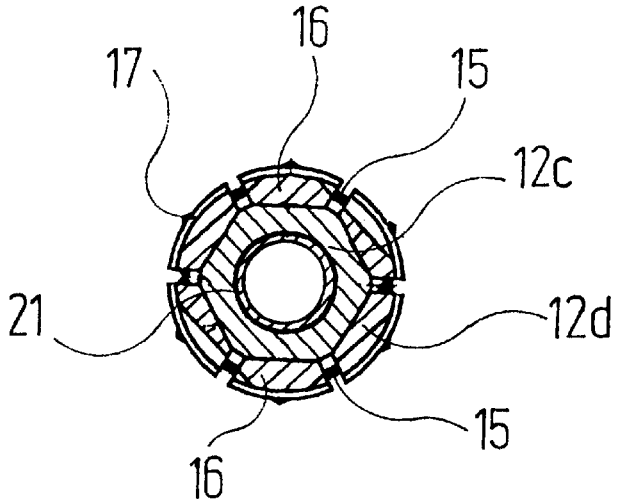
FIG. 3 a sectional view according to line III—III of FIG. 1 through the upper and lower part of a securing body used with the bath tap.
Figure 4:
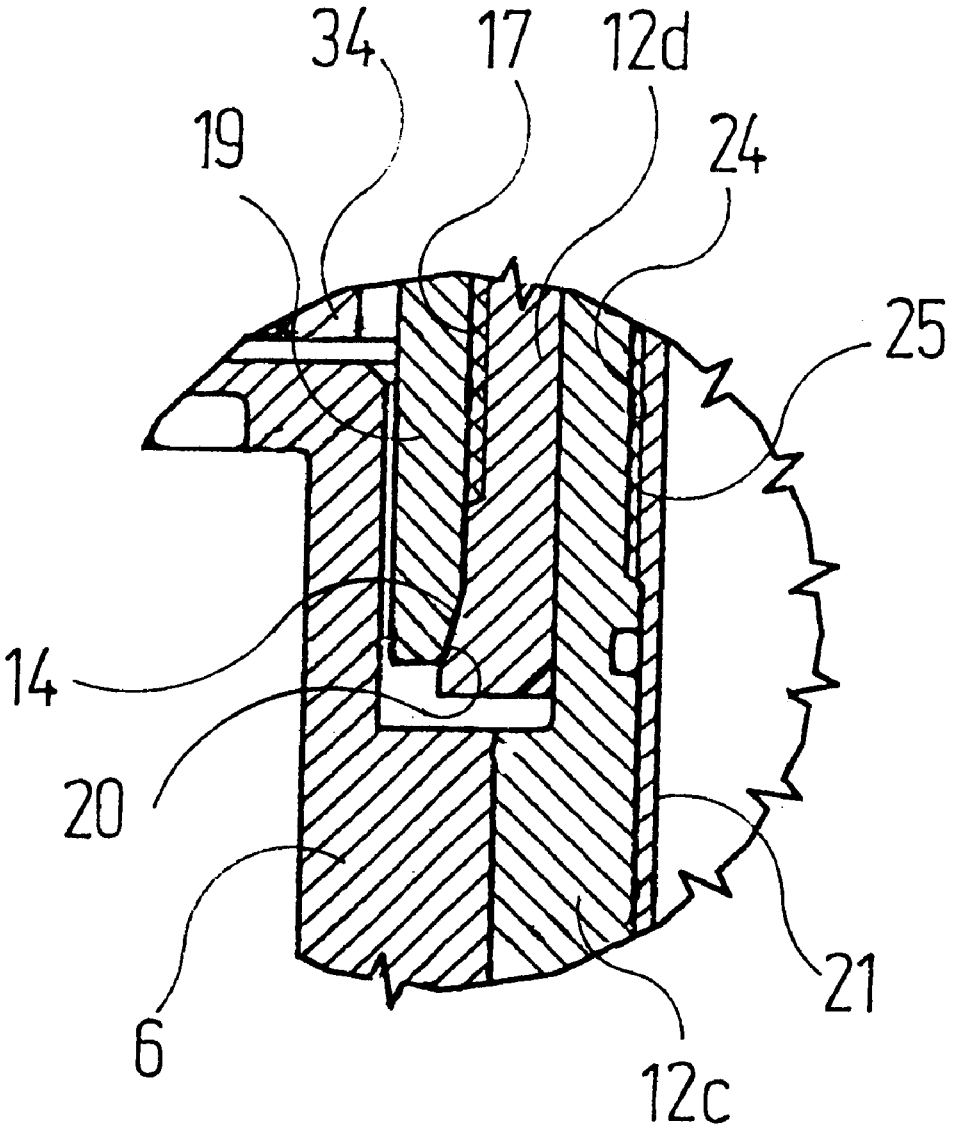
FIG. 4 a blown-up sectional view from FIG. 1.

The outer contour of the upper area of the skirt 12*d* of the upper part 12*b* of the securing body 12 has the cross-section shape of a square with rounded corners, as can also be seen from FIGS. 2 and 3. At the lower end the outer diameter of the skirt 12*d* is expanded over a cone face 14 (compare FIG. 4) to a greater radius. In this lowest area the skirt 12*d* is also divided by slits 15 running parallel to the axis (compare FIGS. 1 and 3) into individual segments 16.

In the area directly above the slits 15 an outer thread 17 onto which a nut 18 is screwed is cut into the outer surface area of the skirt 12*d* of the upper part 12*b* where the outer cross-section is circular. As also can be seen in particular from FIG. 4, a cone face 20 is also molded onto the inner surface area of a downward running skirt 19 of the nut 18, so that the radius of the inner surface area is expanded downward. The cone face 20 of the nut 18 lies on the roughly complementarily inclined cone face 14 of the skirt 12*d* of the upper securing part 12*b*. The arrangement is obviously such, that by screwing down the nut 18 onto the outer thread 17 of the upper securing part 12*b* the segments 16 located at its lower end can be pressed radially inwards against the neck 12*c* of the lower securing part 12*a*.

An adjusting bush 21 is led from above into the drilled hole of the neck 12*e* of the upper securing part 12*b* and axially fixed to this by a clip ring 22, whereby however relative turning between the adjusting bush 21 and the upper securing part 12*b* is possible. For this purpose the clip ring 22 is engaged in grooves on the faces of the adjustment bush 21 and upper securing part 12*b* turned toward each other. Two short, axially running slits 23 on which a machined part can be fitted to turn the adjusting bush 21 are provided at the upper end of the adjusting bush 21.

The adjusting bush 21 extends with an area bearing an outer thread 24 into the drilled hole of the lower securing part 12*a* and interacts with an inner thread 25 cut there. The adjoining area of the adjusting bush 21 further downward has a smooth, cylindrical surface area which lies on the surface of the drilled hole 26 of the lower securing part 12*a*.

The outlet spout 5 in the vicinity of its lower end has a first transverse wall 27 which is pierced by a drilled hole 28 which also has the cross-section shape of a square with rounded corners. The skirt 12*d* of the upper securing part 12*b* is led through the drilled hole 28 of the transverse wall 27; the flat faces of the skirt 12*d* in this case lie on the flat faces of the drilled hole 28 with hardly any play.

A grub screw 30 is screwed into a threaded hole 29 fed essentially radially through the transverse wall 27. The outer profile of the skirt 12*d* of the upper securing part 12*b* is angled in comparison to the threaded hole 29 so that the grub screw 30 does not strike a flat face but the rounded connecting face between two flat faces of the skirt 12*d*.

The neck 12*e* of the upper securing part 12*b* penetrates a complementarily shaped drilled hole 31 in a second transverse wall 32 of the outlet spout 5 and is guided by this.

The underside of the outlet spout 5 lies on the upper side of a cover plate 33 which in turn lies on the upper side of the mounting plate 2 and partly covers the flange 8 of the push-in nozzle 6. A cylindrical guiding collar 34 molded on the underside of the outlet spout 5 in this case extends into the inner recess of the cover plate 33 and is guided in this way.

The bath tap 1 on the mounting plate 2 is fitted and adjusted as follows:

Firstly the unit consisting of push-in nozzle 6 and securing lower part 12*a* is fitted to the mounting plate 2. This is done by feeding the push-in nozzle 6 from above through the aperture 4 of the mounting plate 2, after which the nut 9 is screwed tight from below against the shim disks 10, 11 and thus indirectly against the underside of the mounting plate 2.

Now the upper securing part 12*b* which together with the adjusting bush 21 forms a unit, is seated onto the lower securing part 12*a*. For this purpose the lower area of the adjusting bush 21 is led into the drilled hole 26 of the lower securing part 12*a*. This can be done firstly by pushing; as soon as the outer thread 24 of the adjustment bush 21 however engages the inner thread 25 of the lower securing part 12*a*, the adjusting bush 21 and upper securing part 12*b* are further moved by screwing the adjusting bush 21. The skirt 12*d* of the upper securing part 12*b* is now pushed so that it does not turn over the neck 12*c* of the lower securing part 12*a*. The downward movement is carried on as far as this is necessary in view of the thickness of the mounting plate 2 and any possible decorative covering on this, for example tiling. When the correct relative height of the upper securing part 12*d* in relation to the lower securing part 12*a* is reached, the nut 18 is screwed onto the outer thread 17 of the upper securing part 12*b*. The cone face 20 at the lower end of its skirt 19 now presses the individual segments 16 of the upper securing part 12*b* inwards against the corresponding faces of the lower securing part via a cam effect with the cone face 14 of the skirt 12*d* of the upper securing part 12*b*. As a result any play between upper securing part 12*b* and lower securing part 12*a* is completely eliminated and moreover the relative vertical position between these two securing parts 12*a*, 12*b* is fixed.

Now the cover plate 33 is put in position.

In a final stage the outlet spout 5 is fitted to the securing device 3. For this purpose the neck 12*e* of the upper securing part 12*b* is led into the complementary drilled hole 31 of the second transverse wall 32 and the skirt 12*d* of the securing upper part 12*b* into the corresponding seating aperture 28 of the first transverse wall 27.

The outlet spout 5 is finally fixed on the upper securing part 12*b* by screwing in the grub screw 30 inside the threaded hole 29 of the outlet spout 5. Its face is now pressed against a rounded connecting face of the skirt 12*d*, as a result of which the outlet spout 5 is pulled in the opposite direction, in FIG. 1 i.e. to the right, so that the two flat faces of the seating aperture 28 lying on the left in FIG. 1 are pressed against the two adjacent flat faces of the skirt 12*d*. The skirt 12*d* is thus pressed by the grub screw 30 to a certain extent "into the corner" of the seating aperture 28, as a result of which a kind of jamming and tolerance-free fixing results in two directions which is reinforced by fixing in a third direction with the grub screw 30. In this way the outlet spout 5 is connected to the upper securing part 12*b* completely devoid of play.

Even if great forces and torques are applied to the outlet spout 5 the described securing device 3 of the outlet spout 5 remains firm.

The various structural elements of the securing device 3 which were described above, are sealed against each other at the necessary places by O-rings which have not been described in detail. The grooves in the structural elements, in which these seals are seated, are outlined in the drawing.

What is claimed is:

1. A bath tap fitting comprising:

a) a securing device which can be fitted to a mounting plate and has:

aa) a securing body which is composed of a lower part and an upper part which can be pushed onto the lower part so that it cannot turn but can be adjusted for height;

ab) an adjusting bush which in the upper area is axially fitted on the upper part of the securing body, but in contrast to this can be turned and in the lower area is screwed into a threaded hole of the lower part of the securing body;

ac) a securing device, which sets the height of the upper part of the securing body in relation to the lower part;

b) an outlet spout which can be fitted onto the upper part of the securing body, characterized in that c) the upper part of the securing body grips over the lower part so that it cannot turn with a skirt which is divided into segments from underneath by slits and in which the area adjacent to the slits bears an outer thread;

d) a nut is screwed onto the outer thread of the skirt of the upper part which via a cam effect in each case depending on the amount of turn presses the segments of the skirt of the upper part to a greater or lesser extent against the lower part of the securing body.

2. A bath tap fitting according to claim 1, characterized in that the skirt of the upper part is expanded downward in the area of the slits over a cone face and that the inner surface of the nut is expanded downward at its lower end over a complementary cone face.

* * * * *